US006637613B2

(12) United States Patent
Shimada et al.

(10) Patent No.: US 6,637,613 B2
(45) Date of Patent: Oct. 28, 2003

(54) BOTTLE HAVING FLATTENED CROSS SECTIONAL SHAPE

(75) Inventors: Shinji Shimada, Koto-Ku (JP); Atsushi Ohta, Koto-Ku (JP); Tomoya Sueki, Koto-Ku (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 09/837,200

(22) Filed: Apr. 19, 2001

(65) Prior Publication Data

US 2001/0022291 A1 Sep. 20, 2001

(51) Int. Cl.[7] ..... B65D 90/00
(52) U.S. Cl. ..... 215/382; 220/660
(58) Field of Search ..... 215/382, 379, 215/381, 383, 384; 220/660, 669, 676

(56) References Cited

U.S. PATENT DOCUMENTS

| | | | | | |
|---|---|---|---|---|---|
| D192,452 | S | * | 3/1962 | Palazzo | D58/6 |
| D212,587 | S | * | 11/1968 | Shepler | D9/91 |
| 3,536,500 | A | * | 10/1970 | Cleereman et al. | 99/171 |
| D234,911 | S | * | 4/1975 | Stevens, Jr. | D9/117 |
| D283,306 | S | * | 4/1986 | Davis | D9/385 |
| 4,946,053 | A | * | 8/1990 | Conrad | 215/381 |
| 5,101,990 | A | * | 4/1992 | Krishnakuma et al. | 215/1 C |
| 5,226,538 | A | * | 7/1993 | Roselle | 206/457 |
| 5,238,129 | A | * | 8/1993 | Ota | 215/381 |
| 5,350,078 | A | * | 9/1994 | Potts et al. | 215/100 A |
| D352,461 | S | * | 11/1994 | Flanagan et al. | D9/542 |
| D384,285 | S | * | 9/1997 | D'Amico et al. | D9/542 |
| D407,649 | S | * | 4/1999 | McCallister et al. | D9/520 |
| 5,908,127 | A | * | 6/1999 | Weick et al. | 215/373 |
| D419,061 | S | * | 1/2000 | Croft et al. | D9/333 |
| 6,145,681 | A | * | 11/2000 | Chimetto et al. | 215/384 |
| D446,127 | S | * | 8/2001 | Adee et al. | D9/563 |

* cited by examiner

*Primary Examiner*—Lee Young
*Assistant Examiner*—Lien Ngo
(74) *Attorney, Agent, or Firm*—Oliff & Berridge, PLC

(57) ABSTRACT

A flattened bottle comprising a neck, a shoulder, a body and a bottom;

said body having an upper body section, a lower body section and a middle body section, said upper body section and said lower body section showing a substantially rectangular cross section with quadrant corners;

said middle body section showing an elliptic cross section and having inwardly deformable front and rear walls and inwardly curved side walls, said side walls being adapted to be deformed outwardly corresponding to any inward deformation of the front and rear walls due to pressure reduction.

3 Claims, 5 Drawing Sheets

A

BOTTLE HAVING FLATTENED CROSS SECTIONAL SHAPE

BACKGROUND OF THE INVENTION

This invention relates to a bottle having a flattened cross sectional shape, and more particularly, to a hot-fill type bottle having a flattened cross sectional shape.

Cylindrical and regularly polygonal bottles provided with pressure reduction absorbing surfaces and operating as hot-fill bottles are known. However, when flattened bottles having body and showing an elliptic or rectangular cross section are used for hot-fill applications, the oppositely disposed flat walls become curved toward the inside when capped and cooled after the hot-fill operation and the lateral body walls connecting the flat walls are bulged toward the outside at a central part thereof.

Then, the bulged areas of the side walls of such bottles often give rise to problems when the bottles are transported after the hot-fill and cooling process. Additionally, if the bottles are packaged, the shoulders and/or the bottoms can become projecting during the transportation to reduce the efficiency of transportation.

Still additionally, when such bottles are displayed for sale, they are poorly appealing because of the bulged side walls.

Because of the above identified drawbacks, flattened bottles have not been used as hot-fill bottles.

SUMMARY OF THE INVENTION

In view of the above problems, it is therefore the object of the present invention to provide a flattened bottle having a pair of flattened body walls and a pair of side walls connecting the flattened body walls and being adapted to be deformed outward but located inside relative to the vertical planes connecting the upper and lower edges of the side walls corresponding to the curved deformation of the flat walls due to pressure reduction during and after the hot-fill and cooling process.

According to the invention, the above object is achieved by providing a flattened bottle comprising a neck, a shoulder, a body and a bottom, said body having an upper body section, a lower body section and a middle body section, said upper body section and said lower body section showing a substantially rectangular cross section with quadrant corners, said middle body section showing an elliptic cross section and having inwardly deformable front and rear walls and inwardly curved side walls, said side walls being adapted to be deformed outward corresponding to any inward deformation of the front and rear walls due to pressure reduction.

Preferably, said side walls are located inside relative to the vertical planes connecting the upper and lower ends of the side walls when they are deformed.

Preferably, the front and rear walls of the middle body section are provided with a plurality of horizontally extending ribs that allow the front and rear walls of the middle body section to be easily deformed during the process of filling the bottle with hot liquid and subsequently cooling the bottle.

A flattened bottle according to the invention provides the following advantages.

Since the middle body section of a flattened bottle according to the invention has inwardly deformable front and rear walls and side walls that are inwardly curved, the side walls are adapted to be deformed outward but located inside relative to the vertical planes connecting the upper and lower ends of the side walls corresponding to the curved deformation of the flat walls due to pressure reduction during and after the hot-fill and cooling process.

Therefore, the side walls of the bottle do not be bulged and hence the bottle can remain free from problems that may otherwise arise when it is transported after the cooling process so that the efficiency of transportation can be improved.

DETAILED DESCRIPTION OF THE PREFERRED EMBODIMENTS

Now, the present invention will be described by referring to the accompanying drawings that illustrate preferred embodiments of the invention.

Figure 1:
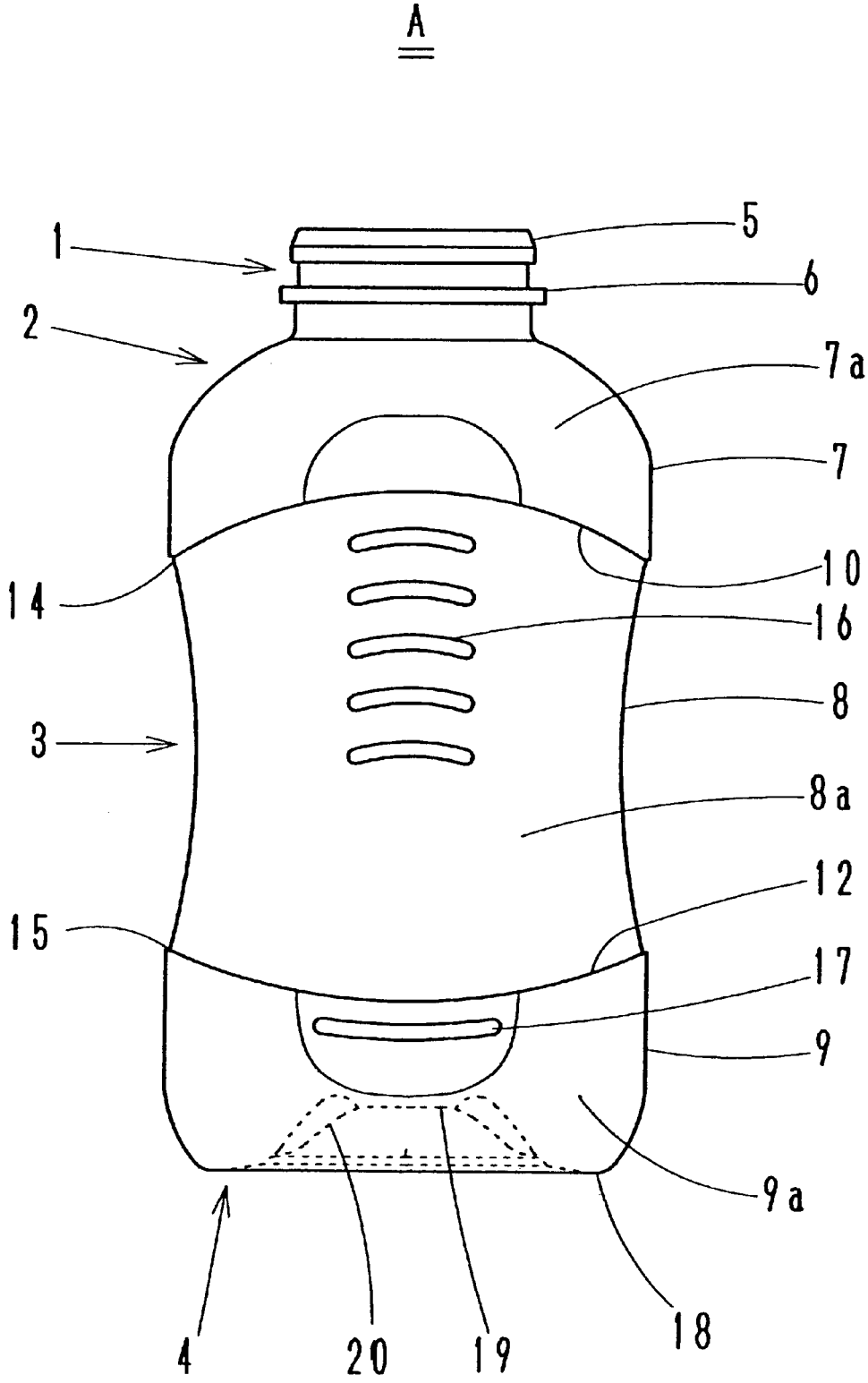
FIG. 1 is a schematic front view of an embodiment of bottle according to the invention.
Figure 2:
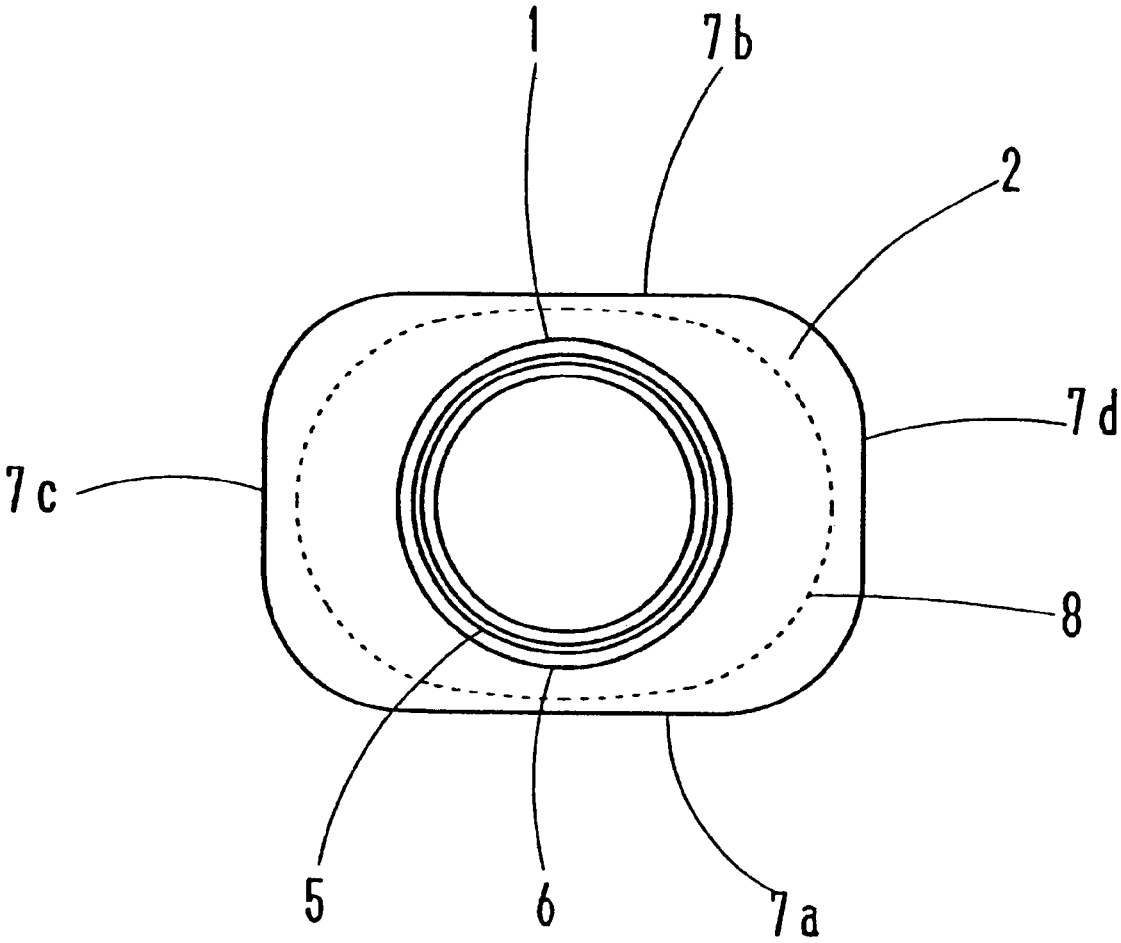
FIG. 2 is a schematic plan view of the bottle of FIG. 1.

Referring to FIG. 1, reference symbol "A" denotes a bottle having a flattened cross sectional shape, formed by biaxially oriented blow molding, and typically made of PET or some other hard synthetic resin material.

The bottle "A" comprises a neck 1, a shoulder 2, a body 3 and a bottom 4. The neck 1 has an engaging ridge 5 and a holder ring 6.

The shoulder 2 has a curved surface, and shows at a lower end thereof a cross section that is rectangular with quadrant corners.

Figure 3:
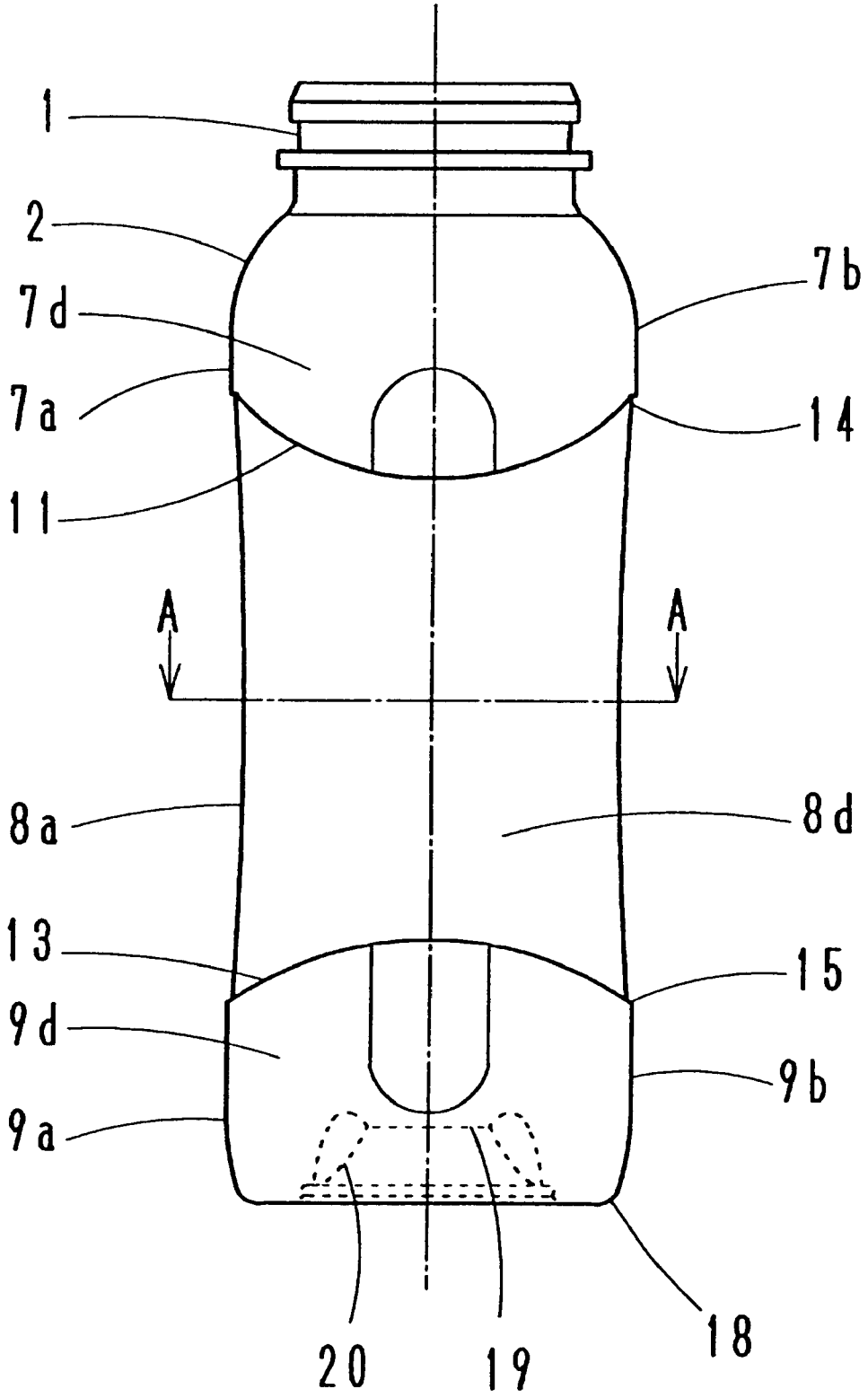
FIG. 3 is a schematic side view of the bottle of FIG. 1.

As seen from FIGS. 1 and 3, the body 3 includes an upper body section 7, a middle body section 8 that is slightly constricted at a center in an axial direction, and a lower body section 9.

The upper body section 7 extends from the lower end of the shoulder 2, and is a cylindrical shape with a rectangular cross section with quadrant corners. The upper body section 7 comprises a front wall 7*a*, a rear wall 7*b*, a left side wall 7*c* and a right side wall 7*d*. Each of the front and rear wall 7*a*, 7*b* has an upwardly arched lower edge 10, 10. Each of the side walls 7*c*, 7*d* has a downwardly arched lower edge 11.

The lower body section 9 has a cylindrical profile substantially same as the upper body section 7 except edges. The lower body section 9 comprises a front wall 9*a*, a rear wall 9*b*, a left side wall 9*c* and a right side wall 9*d*. Each of the front and rear wall 9*a*, 9*b* has a downwardly arched upper edge 12. Each of the side walls 9*c*, 9*d* has an upwardly arched upper edge 13.

The middle body section 8 connects to the arched lower edges 10, 11 of the upper body section 7 and the arched upper edges 12, 13 of the lower body section 9. At an upper end of the middle section 8, a cross section is smaller than that of the upper body section 7 at the lower end thereof. Also, at a lower end of the middle section 8, the cross section is smaller than that of the lower body section 9 at the upper end thereof. Thus, a step 14 is formed between the upper body section 7 and the middle body section 8, and a step 15 is formed between the lower body section 9 and the middle body section 8.

The middle body section 8 comprises a front wall 8*a*, a rear wall 8*b*, a left side wall 8*c* and a right side wall 8*d*. Each of the front and rear walls 8*a*, 8*b* is vertically slightly curved inwardly. Each of the side walls 8*c*, 8*d* is inwardly curved at a center of the axial direction, and has almost recessed central areas.

Figure 4:
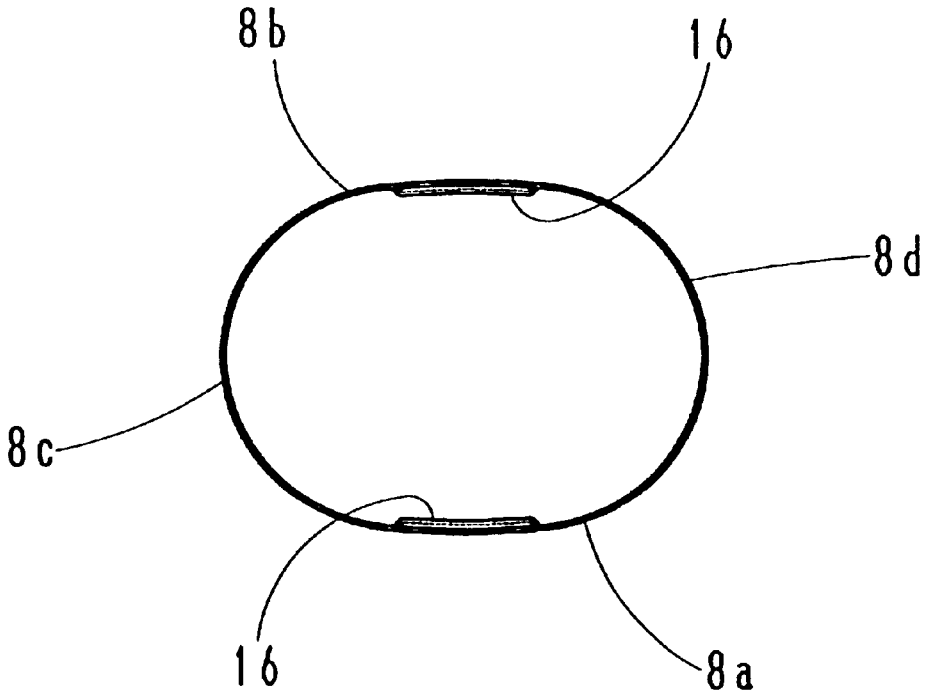
FIG. 4 is a schematic cross sectional view of the bottle of FIG. 1 taken along line A—A in FIG. 3.

The middle body section 8 shows a cross section similar to the upper and lower body sections 7, 9 at upper and lower ends thereof. On the other hand, at a center in an axial direction, the middle body section 8 is dimensionally slightly reduced in each of the front and rear walls as illustrated in FIG. 3, and more remarkably in the left and right walls as illustrated in FIG. 1, so that it has an almost elliptical cross section at the center as shown in FIG. 4.

Each of the front and rear walls 8*a*, 8*b* is provided in an upper area thereof with a plurality of horizontally extending arcuate ribs 16 which are arranged at a center in a lateral direction of the front and rear walls 8*a*, 8*b*.

Due to the arcuate ribs 16, the walls of the body of the bottle is radially oriented to reduce the wall thickness in the molding process. Also, the ribs 16 reinforce the walls.

The lower body section 9 shows a rectangular cross section with rounded corners 12, 13 like the upper body section 7. Each of the front and rear walls 9*a*, 9*b* of the lower body section 9 is provided in upper central area thereof with one or more arcuate ribs 17.

The bottom 4 includes a bottom end wall 18 extending from the lower end of the lower body section 9 and a bottom wall 19 that is upwardly recessed relative to the bottom end wall 18 and provided with reinforcement bottom ribs 20.

Now, the function and the effect of the embodiment having the above described configuration will be discussed below.

The bottle "A" is filled with heated and sterilized drink liquid, capped and then cooled.

As the bottle "A" is cooled, an internal pressure of the bottle "A" is reduced, and the walls of the container is subjected to an external force of the pressure difference between an atmospheric pressure and the internal pressure.

Both the neck 1 and the bottom 4 have a large wall thickness and are thus reinforced, they are free from deformation if the internal pressure of the bottle A is reduced.

While the shoulder 2 and the upper body section 7 extending from the neck 1 and the lower body section 9 extending from the bottom 4 may be slightly bent and deformed along the lines connecting respectively the neck 1 and the shoulder section 2 and the bottom 4 and the lower body section 9, their cross sections substantially maintain the respectively original profiles.

The front and rear walls 8*a*, 8*b* and the side walls 8*c*, 8*d* of the middle body section 8 are bent along the upper and lower steps 14, 15, and deformed as pressure reduction absorbing surfaces.

Figure 5:
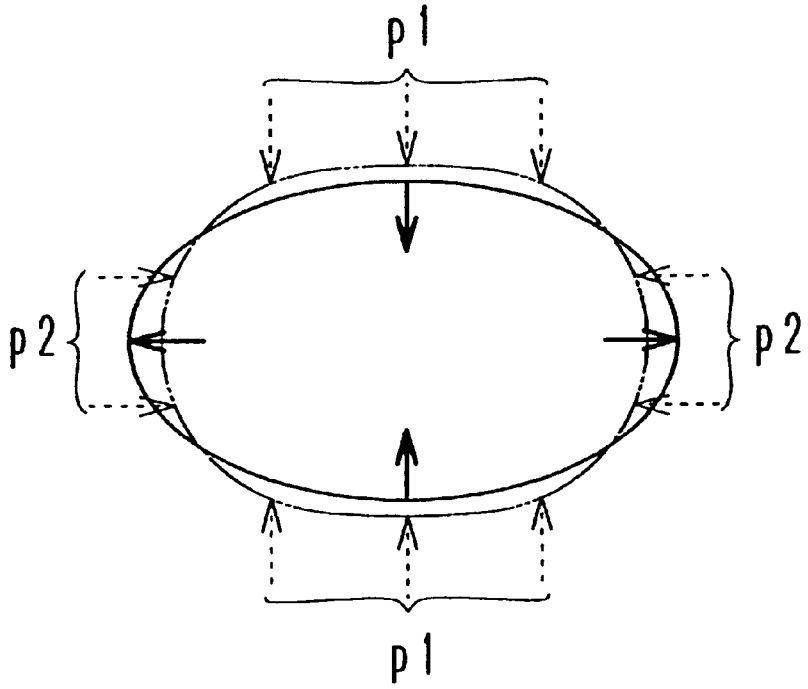
FIG. 5 is a schematic cross sectional view of the bottle of FIG. 1, illustrating how it is deformed in the cooling process.

As described above, the middle body section 8 shows the rectangular cross section with quadrant corners at the upper and lower ends, and the substantially elliptic cross section at the center. Area of each of the front and rear walls 8*a*, 8*b* is larger or wider than that of the side walls 8*c*, 8*d*. Therefore, as the internal pressure is reduced, a force "p1" exerted onto the front and rear walls 8*a*, 8*b* is greater than a force "p2" exerted onto the side walls 8*c*, 8*d* as shown in FIG. 5, so that the bottle tends to be deformed inwardly in a front-back direction, so as to tends to be deformed outwardly in a right-left direction in response to the deformation in a front-back direction, as indicated by arrows in FIG. 5.

Since each of the side walls 8*c*, 8*d* is inwardly bent with almost recessed central area, the inwardly bent surface protrude outwardly from its inwardly bent shape, so that the side walls do not protrude from the upper body section 7 and the lower body section 9 in the lateral direction. In other words, when the reduced internal pressure is absorbed, each of the side walls become like a straight.

In this case, each of the front and rear walls 8*a*, 8*b* is formed with the arcuate rib 16, so that the area formed with the arcuate rib 16 has a thick wall. Thus, the front and rear walls 8*a*, 8*b* can easily be deformed.

In order to become each of the side walls like a straight, a specific profile or a dimension of the front and rear walls 8*a*, 8*b* and the side walls 8*c*, 8*d* can be obtained as follows. By computation and experiments, a reduced pressure due to the hot-filling and the cooling, a deformation of the front and rear walls 8*a*, 8*b* due to a reduced pressure, a deformation of the side walls 8*c*, 8*d* due to the deformation of the front and rear walls are obtained, so as to determine the specific profile or the dimension of the front and rear walls 8*a*, 8*b* and the side walls 8*c*, 8*d*.

Now, another embodiment of a bottle according to the invention will be described below.

Figure 6:
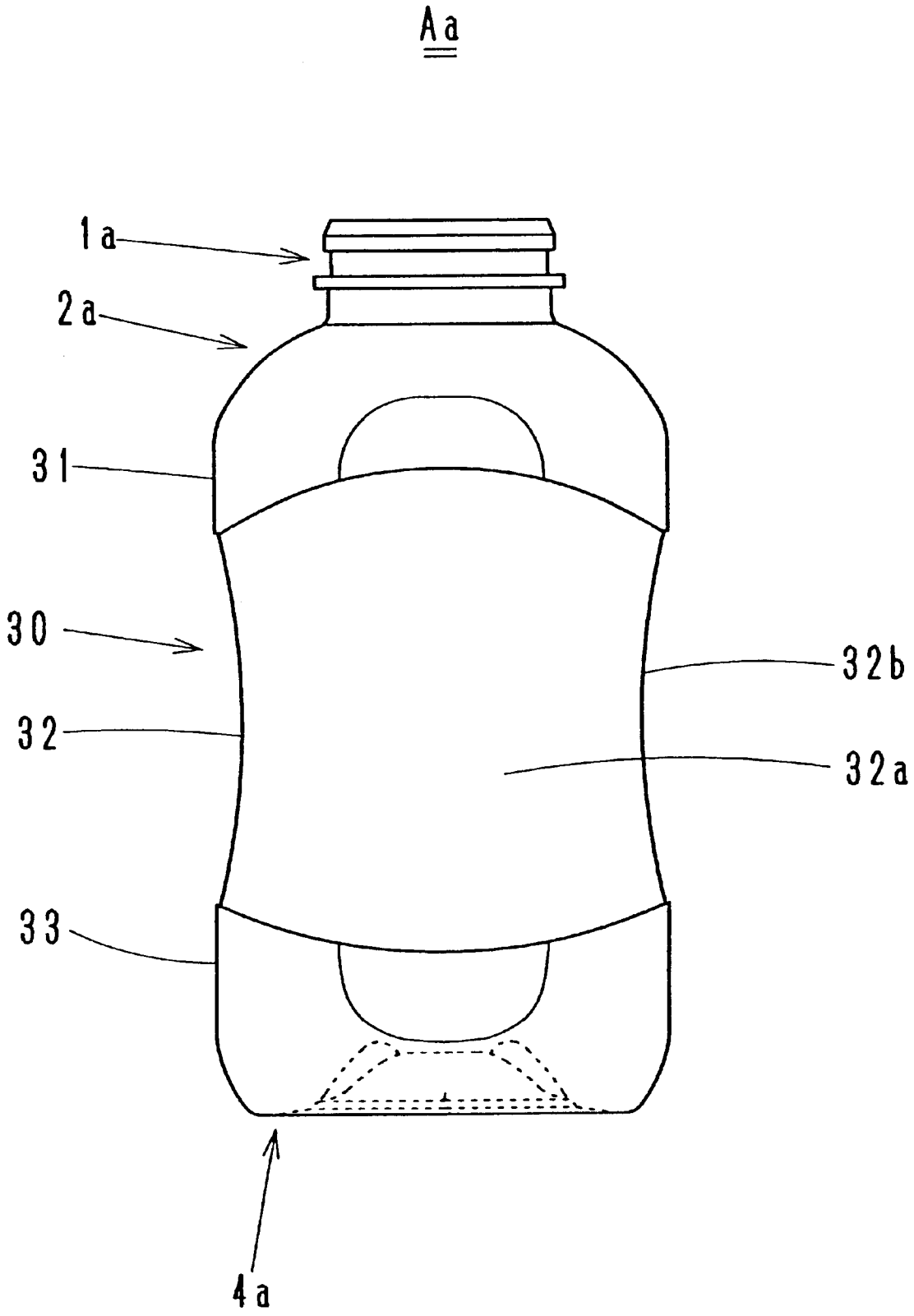
FIG. 6 is a schematic front view of another embodiment of bottle according to the invention.

This embodiment is similar to the above described embodiment except that this embodiment does not provide a rib in the front and rear walls of the body as illustrated in FIG. 6. Therefore, this embodiment will be described only in terms of the difference.

Referring to FIG. 6, bottle "Aa" comprises a neck "1*a*", a shoulder "2*a*", a body 30 and a bottom "4*a*". The body 30 comprises an upper body section 31, a middle body section 32 that is constricted at a center thereof in an axial direction, and a lower body section 33.

Like the above described embodiment, each of the front and rear walls 32*a*, 32*a* of the middle body section 32 of this embodiment is slightly curved inwardly, while each of the side walls 32*b* of the middle body section 32 is curved inwardly.

Since the front and rear walls 32*a*, 32*a*, the side walls 32*b*, 32*b* and the areas (steps) connecting the middle body section 32 to the upper body section 31 and the lower body section 33 are same as their counterparts of the above embodiment in terms of profile and in other respects, they will not be described any further.

This embodiment provides the function and the effect described above by referring to the first embodiment except those of the ribs.

While the front and rear walls of the middle body section of each of the above embodiments are slightly curved inwardly, they may alternatively be slightly curved toward outwardly or made to extend almost straightly.

The specific profile of the front and rear walls and that of the side walls can be designed appropriately to make them adapted to the pressure reduction in the hot-fill and cooling process.

While the middle body section has upper and lower steps in each of the above described embodiments, such steps may not necessarily be provided.

Finally, while the neck of each of the above described embodiments has an engaging ridge at the top thereof for engagedly receiving a cap, the engaging ridge may be replaced by a screw thread to receive a threaded screw cap.

What is claimed is:

1. A flattened bottle comprising a neck, a shoulder connected to the neck, a body and a bottom;

said body having an upper body section connected to the shoulder, a lower body section connected to the bottom and a middle body section connected to the upper body section at an upper edge and connected to the lower body section at a lower edge;

said upper body section and said lower body section showing a substantially rectangular cross section with quadrant corners;

said middle body section showing a geometrically elliptic cross section and having inwardly deformable front and rear walls and side walls curving inwardly from said upper and lower edges, said side walls deforming outwardly in response to inward deformation of the front and rear walls due to pressure reduction inside said middle body section.

2. A flattened bottle according to claim 1, wherein side walls remain within vertical planes between the upper and lower edges along the side walls when the side walls are deformed.

3. A flattened bottle according to claim 1, wherein each of the front and rear walls of the middle body section includes a plurality of horizontally extending ribs.

* * * * *